US005861355A

United States Patent [19]

Olson et al.

[11] Patent Number: 5,861,355

[45] Date of Patent: Jan. 19, 1999

[54] MULTIPLE PART RECIPE CARD ASSEMBLY AND METHOD OF CONSTRUCTION AND USE OF DUPLICATE LAMINATED RECIPE CARDS

[76] Inventors: David K. Olson; Linda K. Olson, both of 801 Cassins Rd., Naperville, Ill. 60565

[21] Appl. No.: 910,659

[22] Filed: Aug. 13, 1997

Related U.S. Application Data

[60] Provisional application No. 60/026,867 Sep. 30, 1996.

[51] Int. Cl.[6] ..... B41M 5/165

[52] U.S. Cl. ..... 503/201; 156/235; 503/206; 503/226

[58] Field of Search ..... 427/152; 156/235; 503/200, 226, 201, 206

[56] References Cited

U.S. PATENT DOCUMENTS

| | | | |
|---|---|---|---|
| 3,383,121 | 5/1968 | Singer | 503/226 |
| 4,930,813 | 6/1990 | Padel | 283/39 |
| 5,283,093 | 2/1994 | All | 428/41 |
| 5,284,363 | 2/1994 | Gartner et al. | 283/81 |
| 5,362,106 | 11/1994 | Longtin | 283/109 |
| 5,464,254 | 11/1995 | Campbell et al. | 283/109 |

*Primary Examiner*—Bruce H. Hess
*Attorney, Agent, or Firm*—Mark E. Wiemelt

[57] ABSTRACT

The invention relates to a multiple part recipe card kit and method of construction and use of duplicate recipe cards. The recipe card kit includes a plurality of superimposed, coextensive, carbonless recording sheets in combination with a plurality of water-resistent, transparent laminae corresponding to the number of the recording sheets. Each of the recording sheets has a face. The recording sheets have a common joined border and are separable from one another proximate the common joined border. The recording sheets contain pressure-sensitive image-transferring chemicals which allow the recording sheets to receive recorded information simultaneously upon each face when the information is inscribed on the face of the top sheet. Each of the laminae are of sufficient size to completely overlie the corresponding recording sheets. Each of the laminae has a first side. Each first side of the laminae has transparent pressure-sensitive adhesive applied to at least a portion thereof. A removable release liner is releasably adhered to each pressure-sensitive adhesive and coextensively covers each transparent lamina.

12 Claims, 6 Drawing Sheets

FIG. 7

Olson - Page 5 of 6

Olson - Page 6 of 6

MULTIPLE PART RECIPE CARD ASSEMBLY AND METHOD OF CONSTRUCTION AND USE OF DUPLICATE LAMINATED RECIPE CARDS

BACKGROUND OF THE INVENTION

The present invention relates generally to new and improved recipe cards, and in particular to a multiple part recipe card kit. The invention also relates to a method of construction and use of duplicate recipe cards.

Numerous devices have heretofore been proposed for providing recipe cards and methods of use, and these have included U.S. Pat. No. 4,930,813, issued to Pudel on Jun. 5, 1990. However, each of the prior art devices and systems has been found wanting in one or more particulars. Recipe cards are generally constructed of relatively thin paper or cardboard material which is easily bent, disfigured and mutilated through repeated handling and use. As bending, disfigurement and mutilation occurs, the recipe cards become more difficult to read, use and store. Specifically, the relatively thin construction of the recipe cards and repeated handling of same results in recipe cards which do not readily stand on their edges when stacked or stored vertically one behind the other in a recipe box or the like. As a result, the recipe cards become increasingly difficult to store as their shapes deteriorate. Therefore, it is desirable to provide recipe cards which resist bending, mutilation and disfigurement and which are capable of standing on their edges when stacked vertically one behind the other for storage.

Prior art recipe cards also failed to provide sufficient means to prevent smearing, fading or other deterioration of the information printed thereon. Through repeated handling and use, the recipe cards generally absorbed liquid and other stains on their face which resulted in recipes which were increasingly difficult to read. Therefore, it is desirable to provide recipe cards which resist smearing, fading, staining and absorption of liquid and other materials and which are easily cleaned after use for storage.

It is also desirable to provide a fast, easy, efficient and accurate method of duplicating recipes cards for the purpose of exchanging the cards with friends, family and associates and for the purpose of maintaining an archive or back-up copies of the recipe cards.

The invention of this application represents a recent innovation in the art which overcomes the deficiencies of the prior art by providing recipe cards which resist bending, mutilation and disfigurement, which resist smearing, fading, staining and absorption of liquid and other materials, and which are capable of standing on their edges when stacked vertically one behind the other for storage. The invention also provides a fast, easy, efficient and accurate method of construction and use of duplicate recipe cards.

SUMMARY OF THE INVENTION

It is an object of the present invention to provide improved recipe cards.

More specifically, it is an object of the present invention to provide improved recipe cards which resists bending, mutilation and disfigurement.

It is another object of the present invention to provide improved recipe cards which resist staining and absorption of liquid and other materials.

It is a further object of the present invention to provide improved recipe cards which are capable of standing on their edges when stacked vertically one behind the other for storage.

It is yet another object of the present invention to provide a fast, easy, efficient and accurate method of duplicating recipes cards constructed in accordance with the foregoing objects.

It is still a further object of the invention to provide a protective sleeve for encasing recipe cards.

It is therefore an object of the present invention to provide improved recipe cards which have all the advantages of the prior art and none of its disadvantages.

These together with other objects of the invention, along with the various features of novelty which characterize the invention, are pointed out with particularity in the detailed description annexed to and forming a part of this disclosure. For a better understanding of the invention, its operating advantages and the specific objects attained by its uses, reference should be had to the accompanying drawings and descriptive matter in which there is illustrated a preferred embodiment of the invention.

A broad aspect of the invention involves a recipe card kit which include a plurality of superimposed, coextensive, carbonless recording sheets. The sheets may contain identical pre-recorded indicia on their faces. The carbonless recording sheets contain pressure-sensitive image-transferring chemicals which allow the sheets to receive recorded information simultaneously upon their faces when the information is inscribed on the face of the top sheet. The sheets are separable from one another proximate a common joined border.

A somewhat more limited aspect of the invention involves the aforementioned recipe card kit in combination with a plurality of water-resistent, transparent laminae corresponding to the number of sheets separable from the recipe card kit. The transparent laminae are of sufficient size to completely overlie the respective sheets. The transparent laminae contain first sides having transparent pressure-sensitive adhesive applied to at least a portion thereof. A removable release liner is releasably adhered to the pressure-sensitive adhesive and coextensively covers each transparent lamina. Upon separation of the sheets of the recipe card kit and removal of the release liners, the exposed adhesive mountably adheres one of the laminae on each face of the respective sheets thereby forming duplicate recipe cards.

Another aspect of the present invention involves the method of constructing and using duplicate recipe cards. Initially, a user inscribes information on the face of the top sheet of the kit constructed according to the principles of the present invention. The pressure of the inscription coacts with the pressure-sensitive image-transferring chemicals to record the information on the faces of the remaining sheets. The user then separates the sheets along their common border and removes the release liners from the transparent laminae to expose the adhesive. Next, the user aligns and mounts the transparent laminae on the faces of the respective sheets. The adhesive affixes the laminae to the faces of the respective sheets, thereby forming duplicate laminated recipe cards. The laminated recipe cards may then be distributed, stored and used as desired. For example, the laminated recipe cards may be stored vertically one behind the other in a drawer, box or the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and that will form the subject matter of the invention. Those skilled in the art will appreciate that the conception, upon which this disclosure is based, may readily be utilized as a basis for the designing of other devices and systems for carrying out the several purposes of the present invention. It is important, therefore, that the invention be regarded as including such equivalent constructions insofar as they do not depart from the spirit and scope of the present

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Referring now to FIGS. 1–9, there is illustrated a preferred embodiment of the present invention.

Figure 1:
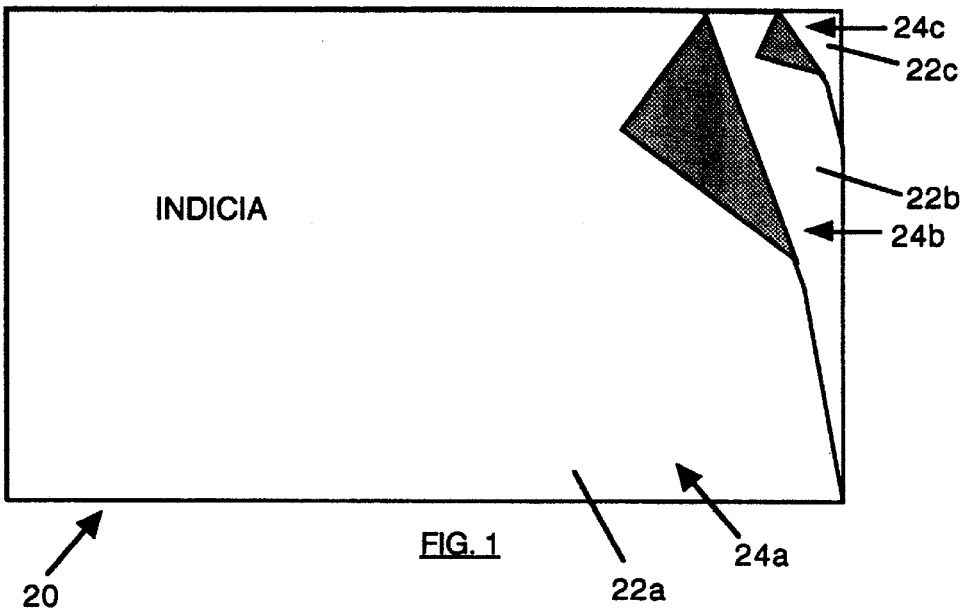
FIG. 1 is a top view of a recipe card kit constructed according to one embodiment of the present invention illustrating three sheets which are partially separated at respective corners and identical pre-recorded indicia on the face of each sheet.
Figure 2:
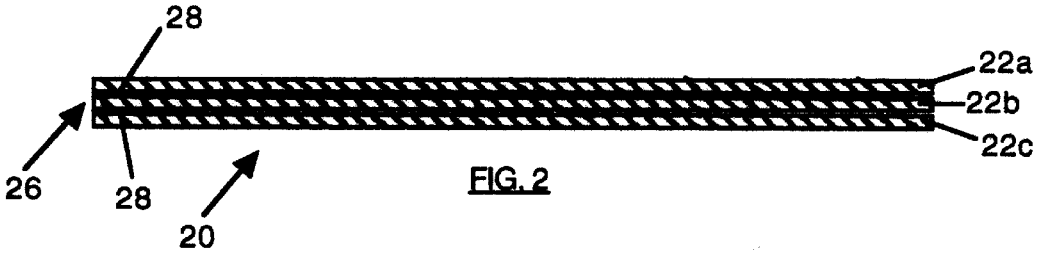
FIG. 2 is a side view of a recipe card kit constructed according to the principles of the present invention, illustrating the common border, glue and three separable sheets.

Referring now to FIG. 1 & 2, the invention comprises a recipe card kit 20 having a plurality of superimposed, coextensive, carbonless recording sheets 22*a*, 22*b* and 22*c*. The sheets 22*a*, 22*b* and 22*c* are separable from one another proximate a common joined border 26. Preferably, the kit 20 includes glue 28 extending traversely across the entire width of the joined sheets 22*a*, 22*b* and 22*c* proximate the common joined border 26 to releasably join the sheets 22*a*, 22*b* and 22*c*. However, it will be readily understood by those skilled in the art that a perforation line (not shown) extending traversely across the entire width of the sheets 22*a*, 22*b* and 22*c* proximate the common border 26 may be used to releasably join the sheets 22*a*, 22*b* and 22*c*. The kit 20 is of the type commercially available from several sources and is commonly referred to as NCR paper. It will be readily understood by those skilled in the art that while three-part paper is illustrated, multiple part paper having any number of separable sheets will suffice.

Figure 3:
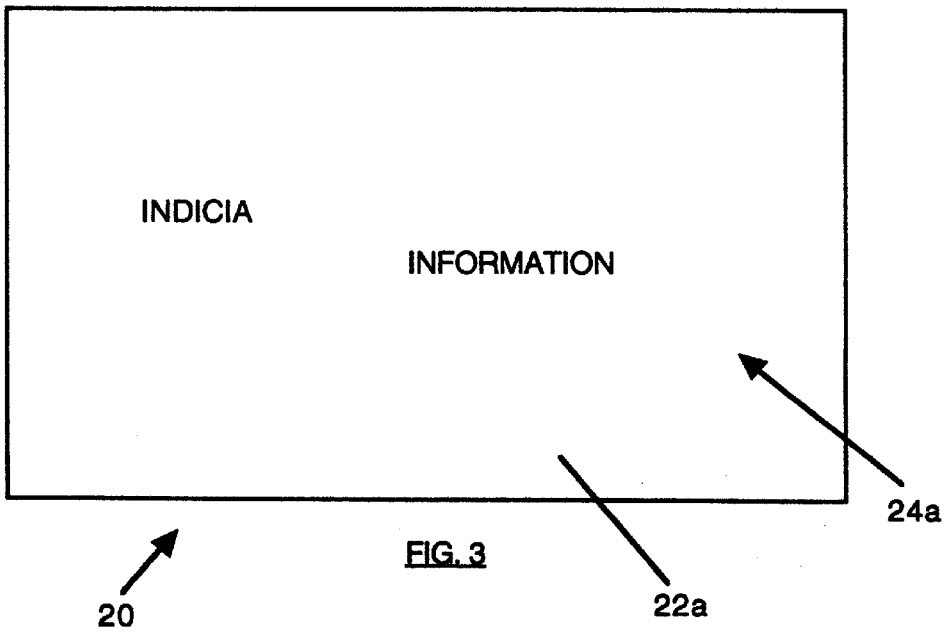
FIG. 3 is a top view of a recipe card kit constructed according to the principles of the present invention, illustrating the pre-recorded indicia and recorded information inscribed on the face of the top sheet.

Referring to FIGS. 1 & 3, the sheets 22*a*, 22*b* and 22*c* of the preferred embodiment contain identical pre-recorded indicia on their faces 24*a*, 24*b* and 24*c*. Although it will should be readily apparent that the sheets 22*a*, 22*b* and 22*c* may be blank. The sheets 22*a*, 22*b* and 22*c* also contain pressure-sensitive image-transferring chemicals (not shown) which allow the sheets 22*a*, 22*b* and 22*c* to receive recorded information simultaneously upon their faces 24*a*, 24*b* and 24*c* when the information is inscribed on the face 24*a* of the top sheet 22*a*, as shown in FIG. 3.

Figure 4:
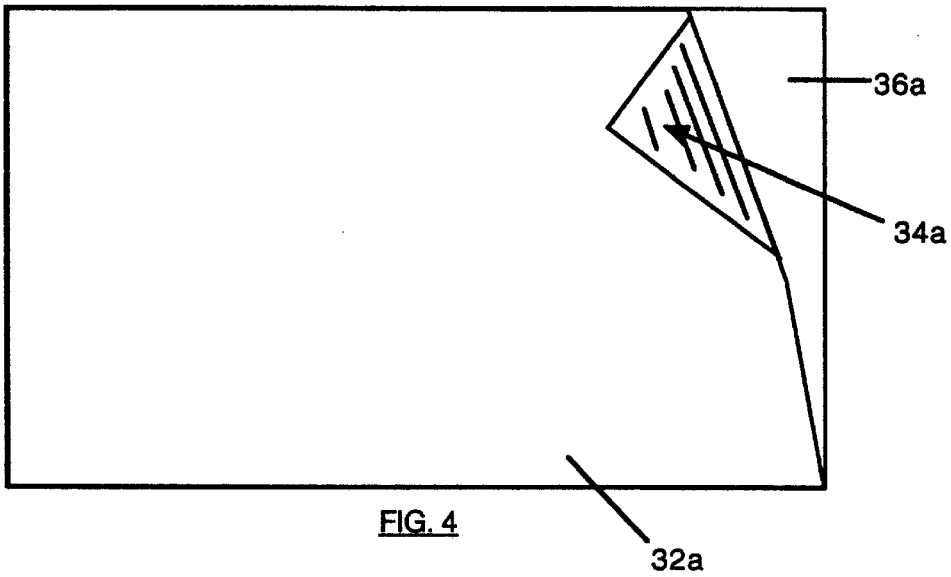
FIG. 4 is a top view of a transparent lamina and release liner constructed according to the principles of the present invention, illustrating the transparent lamina partially separated from the release liner.

Referring to FIGS. 4–7, there is provided a plurality of transparent laminae 32*a*, 32*b* and 32*c* corresponding to the number of sheets 22*a*, 22*b* and 22*c* of the recipe card kit 20. The transparent laminae of the preferred embodiment are formed of a clear polymer plastic although other clear, water-resistent plastics may be substituted. The transparent laminae 32*a*, 32*b* and 32*c* are also of sufficient size to completely overlie the respective sheets 22*a*, 22*b* and 22*c* after their separation from the kit 20. The transparent laminae 32*a*, 32*b* and 32*c* contain first sides 34*a*, 34*b* and 34*c* having transparent pressure-sensitive adhesive 38 applied to at least a portion thereof. As shown in FIG. 4 with respect to transparent lamina 34*a* only for illustrative purposes, removable release liners 36*a*, 36*b* and 36*c* are releasably adhered to the pressure-sensitive adhesive and coextensively cover the first sides 34*a*, 34*b* and 34*c* of the transparent laminae 32*a*, 32*b* and 32*c*.

Figure 5:
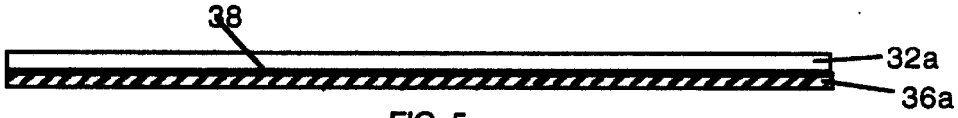
FIG. 5 is a side view of a transparent lamina and release liner constructed according to the principles of the present invention, illustrating the adhesive.

FIG. 5 illustrates the transparent lamina 32*a*, 36*a* release liner and adhesive 38.

Figure 6:
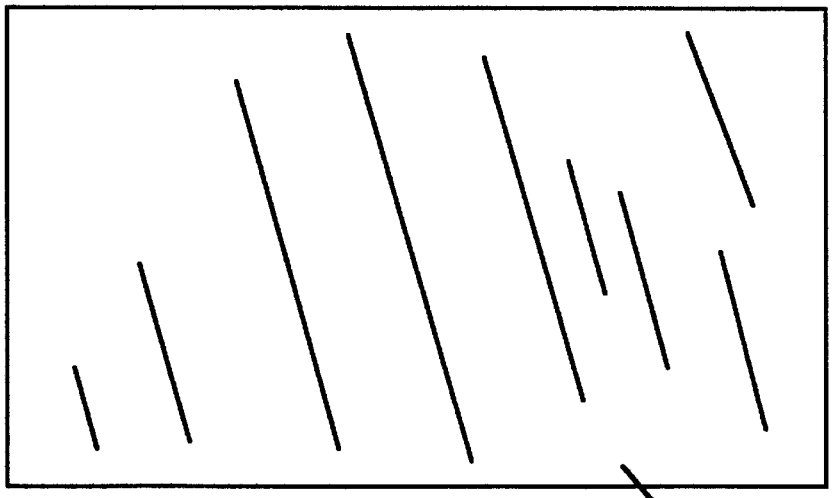
FIG. 6 is a top view of a transparent lamina separated from a corresponding release liner.

FIG. 6 illustrates the transparent lamina 32*a* separated from release liner 36*a*.

Figure 7:
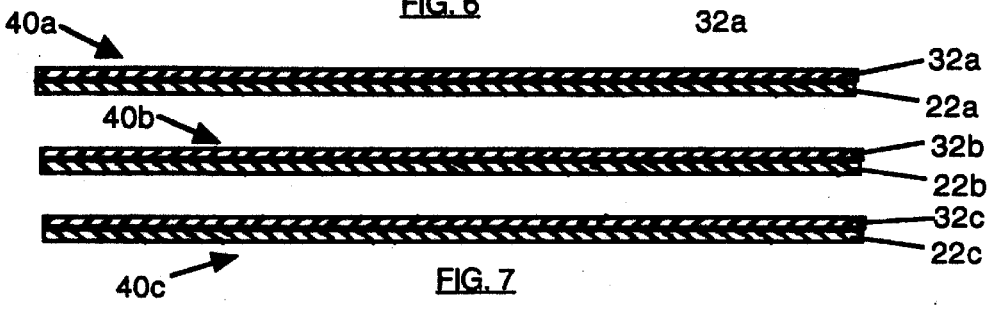
FIG. 7 is a side view of three duplicate laminated recipe cards constructed according to the principles of the present invention, illustrating the transparent laminae and sheets in combination.
Figure 8:
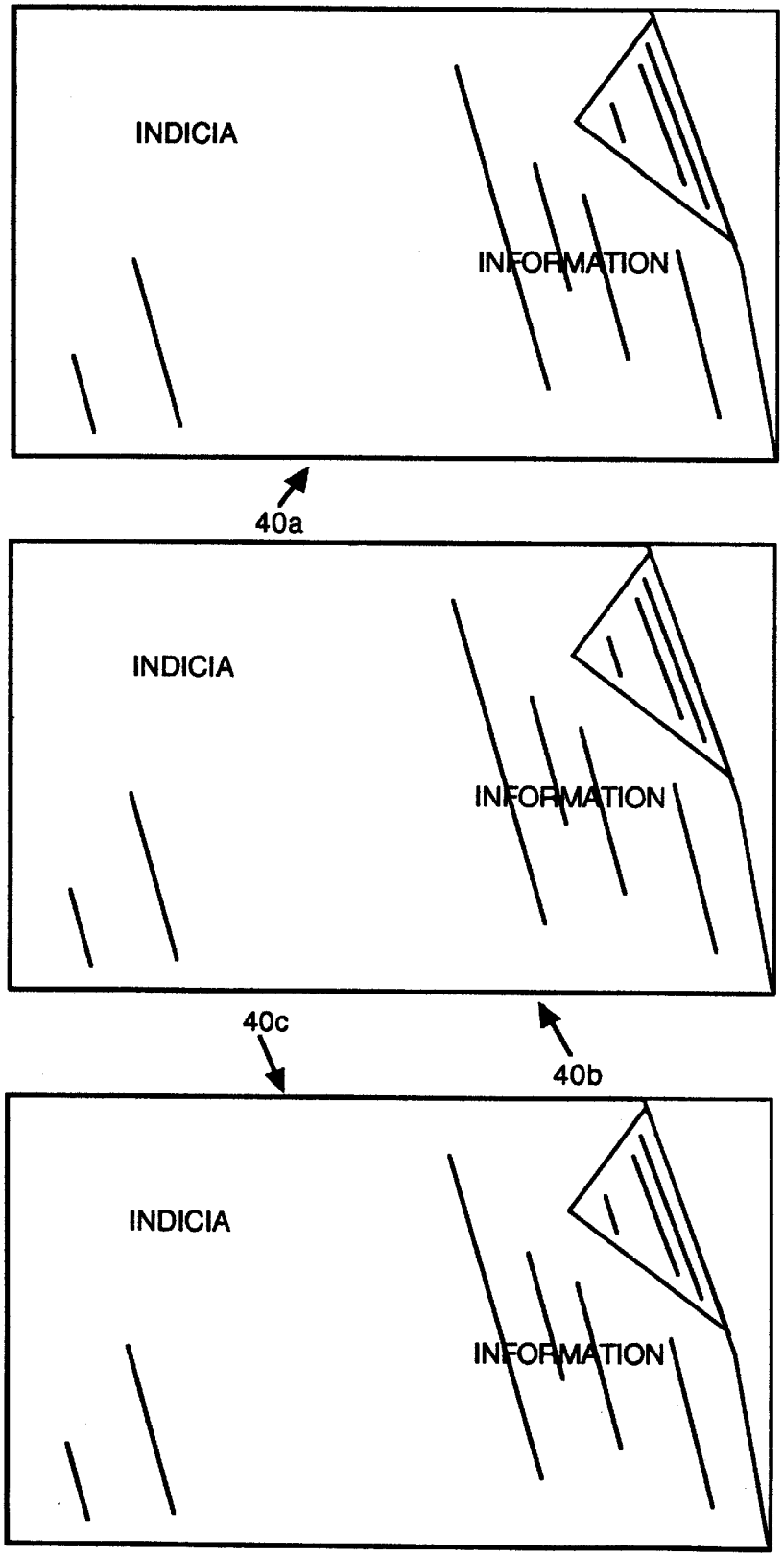
FIG. 8 is a top view of the duplicate laminated recipe cards constructed according to the principles of the present invention, illustrating transparent laminae partially overlying sheets containing pre-recorded indicia and recorded information.

Referring now to FIG. 7 & 8, upon separation and removal of the sheets 22*a*, 22*b* and 22*c* from the recipe card kit 20 and removal of the release liners 36*a*, 36*b* and 36*c* from the transparent laminae 32*a*, 32*b* and 32*c*, the exposed adhesive 38 mountably adheres the transparent lamina 32*a*, 32*b* and 32*c* on the faces 24*a*, 24*b*, and 24*c* of the respective sheets 22*a*, 22*b* and 22*c*, to form duplicate laminated recipe cards 40*a*, 40*b* and 40*c*.

Figure 9:
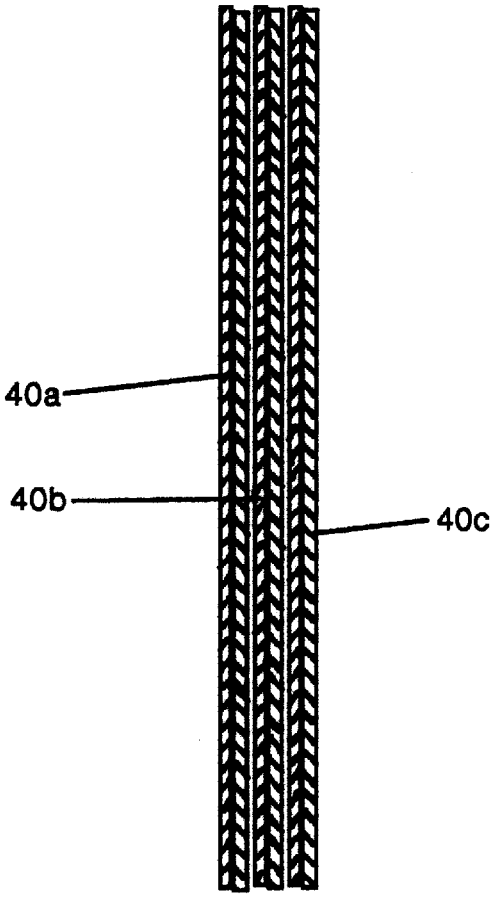
FIG. 9 is a side view of laminated recipe cards constructed according to the principles of the present invention, illustrating their storage vertically one behind the other.
Figure 10:
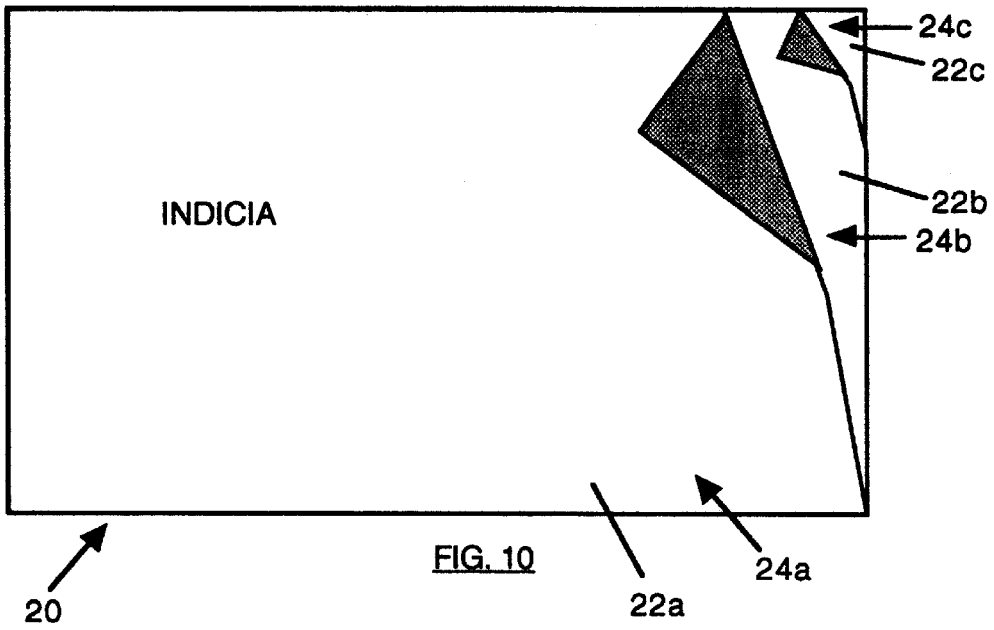
FIG. 10 is a top view of a recipe card kit constructed according to the principles of the present invention illustrating three sheets which are partially separated at respective corners and identical pre-recorded indicia on the face of each sheet.
Figure 11:
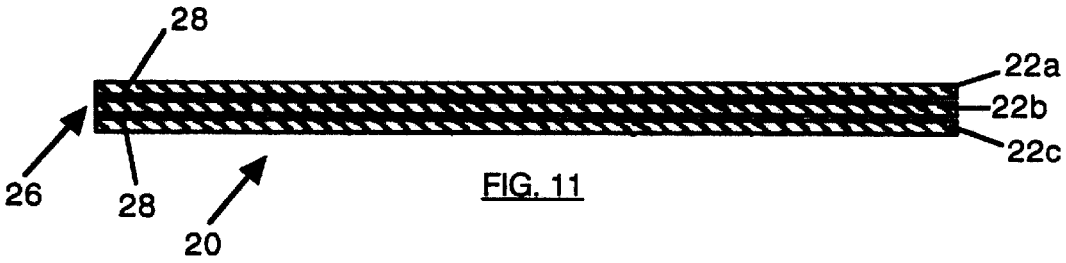
FIG. 11 is a side view of a recipe card kit constructed according to the principles of the present invention, illustrating the common border, glue and three separable sheets.

FIG. 9 shows laminated recipe cards 40*a*, 40*b* and 40*c* as stored vertically one behind the other.

In operation, the user inscribes information on the face 24*a* of sheet 22*a* of the kit 20. The pressure of the inscription coacts with the pressure-sensitive image-transferring chemicals to record the information on the faces 24*b* and 24*c* of the sheets 22*b* and 22*c*. The user then separates the sheets 22*a*, 22*b* and 22*c* along their common border 26 and removes the release liners 36*a*, 36*b* and 36*c* from the transparent laminae 32*a* and mount 32*c* to expose the adhesive 38. Next, the user aligns and mounts the transparent laminae 32*a*, 32*b* and 32*c* on the faces 24*a*, 24*b*, and 24*c* of the respective sheets 22*a*, 22*b* and 22*c*. The adhesive 38 affixes the laminae 32*a*, 32*b* and 32*c* to the faces 24*a*, 24*b*, and 24*c* of the respective sheets 22*a*, 22*b* and 22*c*, thereby forming duplicate laminated recipe cards 40*a*, 40*b* and 40*c*. The laminated recipe cards 40*a*, 40*b* and 40*c* may then be distributed, stored and used as desired.

Referring now to FIGS. 10–16, there is illustrated an alternative embodiment of the present invention comprising a recipe card kit 20 having a plurality of superimposed, coextensive, carbonless recording sheets 22*a*, 22*b* and 22*c*. The sheets 22*a*, 22*b* and 22*c* are separable from one another proximate a common joined border 26. Preferably, the kit 20 includes glue 28 extending traversely across the entire width of the joined sheets 22*a*, 22*b* and 22*c* proximate the common joined border 26 to releasably join the sheets 22*a*, 22*b* and 22*c*. However, it will be readily understood by those skilled in the art that a perforation line (not shown) extending traversely across the entire width of the sheets 22*a*, 22*b* and 22*c* proximate the common border 26 may be used to releasably join the sheets 22*a*, 22*b* and 22*c*. The kit 20 is of the type commercially available from several sources and is commonly referred to as NCR paper. It will be readily understood by those skilled in the art that while three-part paper is illustrated, multiple part paper having any number of separable sheets will suffice.

Figure 12:
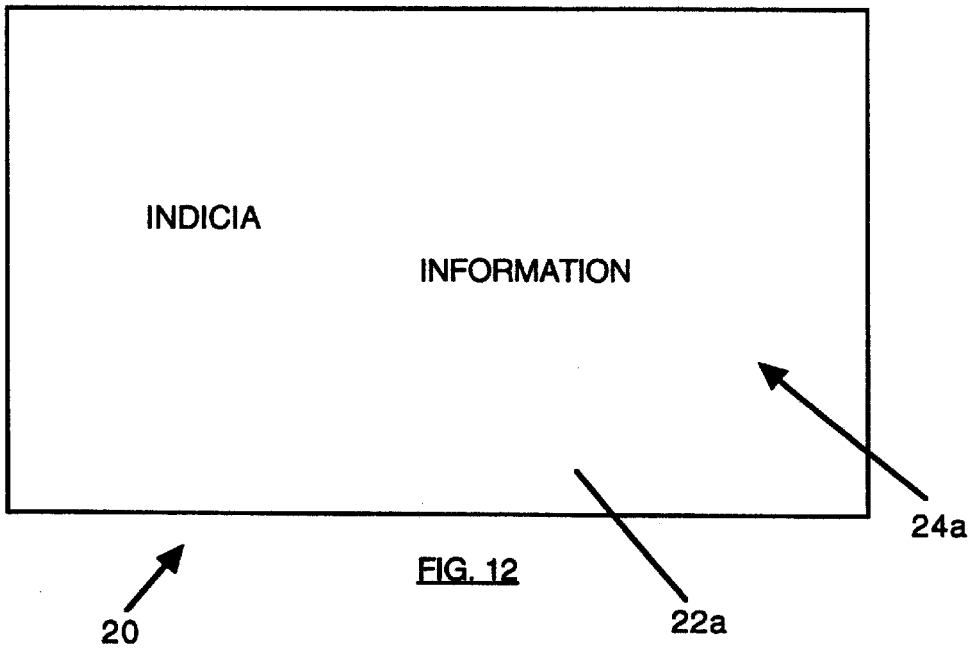
FIG. 12 is a top view of a recipe card kit constructed according to the principles of the present invention, illustrating the pre-recorded indicia and recorded information inscribed on the face of the top sheet.

Referring to FIGS. 12, the sheets 22*a*, 22*b* and 22*c* of the alternative embodiment contain identical pre-recorded indicia on their faces 24*a*, 24*b* and 24*c*. Although it will should be readily apparent that the sheets 22*a*, 22*b* and 22*c* may be blank. The sheets 22*a*, 22*b* and 22*c* also contain pressure-sensitive image-transferring chemicals (not shown) which allow the sheets 22*a*, 22*b* and 22*c* to receive recorded information simultaneously upon their faces 24*a*, 24*b* and 24*c* when the information is inscribed on the face 24*a* of the top sheet 22*a*, as shown in FIG. 12.

Referring to FIGS. 13–16, there is provided a plurality of transparent sleeves 44 corresponding to the number of sheets 22*a*, 22*b* and 22*c* of the recipe card kit 20. The transparent sleeves 44 comprise coextensive, facing planar sidewalls 46 which are formed of a clear polymer plastic, although other clear, water-resistent plastics may be substituted. The sidewalls are joined along their bottom and side borders to define a pocket 48 therebetween of sufficient size to removably receive therein the respective sheets 22*a*, 22*b* and 22*c* after their separation from the kit 20.

Figure 13:
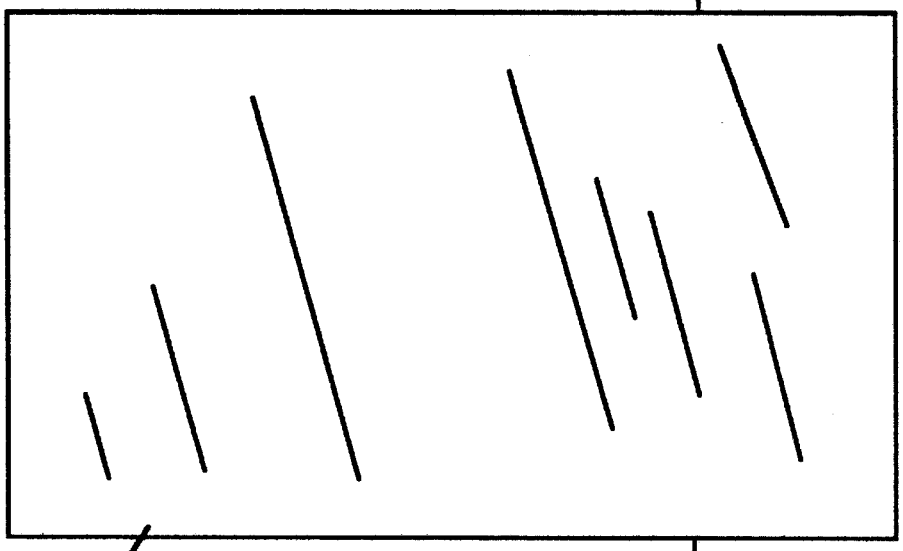
FIG. 13 is a front view of a sleeve constructed according to the principles of the alternative embodiment of the present invention.
Figure 14:
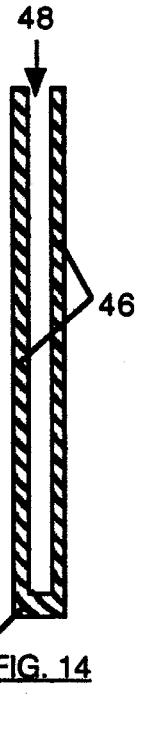
FIG. 14 is a side view of the sleeve constructed according to the principles of the alternative embodiment of the present invention taken along line 14—14 of FIG. 13, illustrating the sidewalls and pocket formed therebetween.

FIGS. 13 & 14 illustrate the transparent sleeve 44.

Figure 15:
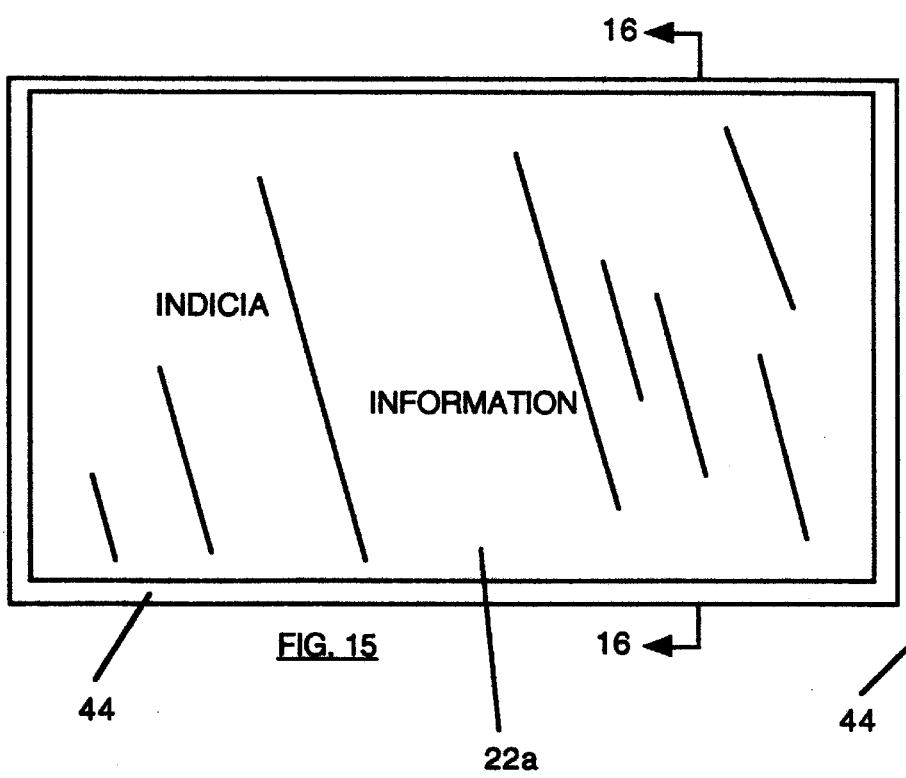
FIG. 15 is a front view of a sleeve constructed according to the principles of the alternative embodiment of the present invention in combination with a sheet containing inscribed information on its face.
Figure 16:
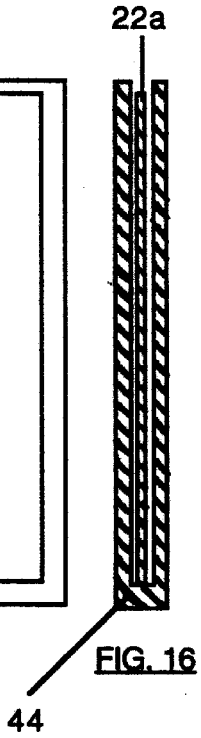
FIG. 16 is a side view of the sleeve constructed according to the principles of the alternative embodiment of the present invention taken along line 16—16 of FIG. 15, illustrating a sheet disposed within the pocket.

FIGS. 15 & 16 illustrate the sheet 22*a* disposed within the transparent sheet 44.

In operation, the user inscribes information on the face 24*a* of sheet 22*a* of the kit 20. The pressure of the inscription coacts with the pressure-sensitive image-transferring chemicals to record the information on the faces 24*b* and 24*c* of the sheets 22*b* and 22*c*. The user then separates the sheets 22*a*, 22*b* and 22*c* along their common border 26. Next, the user inserts the sheets 22*a*, 22*b* and 22*c* into pockets 48 of the respective sleeves 44. While only sheet 22*a* has been illustrated in combination with sleeve 44, it should be readily apparent to one skilled in the art that additional sheets 22*b* and 22*c* may be combined with additional sleeves 44.

While the invention has been described in connection with a preferred embodiment and several alternative embodiments, it will be understood that it is not combination with sleeve 44, it should be readily apparent to one skilled in the art that additional sheets 22*b* and 22*c* may be combined with additional sleeves 44.

While the invention has been described in connection with a preferred embodiment and several alternative embodiments, it will be understood that it is not intended that the invention be limited to those embodiment. On the contrary, it is intended to cover all alternatives, modifications and equivalents as may be included within the spirit and scope of the invention as disclosed.

In view of the above, it will be seen that the several objects of this invention are achieved and other advantageous results are obtained.

As to the manner of usage and operation of the instant invention, same should be apparent from the above disclosure, and accordingly no further discussion relevant to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered illustrative of only the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A recipe card kit comprising:

a plurality of superimposed, coextensive, carbonless recording sheets, each of said recording sheets having a face;

said recording sheets having a common joined border and being separable from one another proximate said common joined border;

said recording sheets containing pressure-sensitive image-transferring chemicals which allow said recording sheets to receive recorded information simultaneously upon each face when the information is inscribed on the face of the top sheet;

a plurality of water-resistent, transparent laminae corresponding to the number of said recording sheets, each of said laminae being of sufficient size to completely overlie said corresponding recording sheets;

each of said laminae having a first side;

each first side of said laminae having transparent pressure-sensitive adhesive applied to at least a portion thereof; and a removable release liner releasably adhered to each pressure-sensitive adhesive and coextensively covering each of said transparent laminae.

2. The recipe card kit of claim 1, wherein said recording sheets have identical pre-recorded indicia on each face.

3. The recipe card kit of claim 1, wherein said laminae are formed of a clear polymer plastic.

4. The recipe card kit of claim 3, wherein said plastic is water-resistent.

5. The method of construction and use of duplicate laminated recipe cards, which comprises;

providing the recipe card kit of claim 1;

inscribing information on said face of said top sheet;

separating said recording sheets from each other;

removing each release liner from each of said laminae to expose said adhesive; and aligning and mounting each of said recording sheets one each on said first sides of said laminae via said adhesive, thereby forming duplicate laminated recipe cards.

6. The method of claim 5 further comprising:

stacking said laminated recipe cards vertically one behind the other for storage.

7. A recipe card kit comprising:

a plurality of superimposed, coextensive, carbonless recording sheets, each of said recording sheets having a face;

said recording sheets having a common joined border and being separable from one another proximate said common joined border;

said recording sheets containing pressure-sensitive image-transferring chemicals which allow said recording sheets to receive recorded information simultaneously upon each face when the information is inscribed on the face of the top sheet; and a plurality of transparent sleeves corresponding to the number of recording sheets, said sleeves comprising coextensive, facing planar sidewalls, said sidewalls being joined along their bottom and side borders to define a pocket therebetween of sufficient size to removably receive therein said recording sheets.

8. The recipe card kit of claim 7, wherein said recording sheets have identical pre-recorded indicia on each face.

9. The recipe card kit of claim 7, wherein said sleeves are formed of a clear polymer plastic.

10. The recipe card kit of claim 9, wherein said plastic is water-resistent.

11. The method of construction and use of duplicate recipe cards, which comprises;

providing the recipe card kit of claim 7;

inscribing information on said face of said top sheet;

separating said recording sheets from each other; and inserting said recording sheets into said pockets of said sleeves.

12. The method of claim 11 further comprising:

stacking said recipe cards vertically one behind the other for storage.

* * * * *